US007048585B2

(12) United States Patent
Milbrand, Jr. et al.

(10) Patent No.: US 7,048,585 B2
(45) Date of Patent: May 23, 2006

(54) HIGH SPEED CONNECTOR ASSEMBLY

(75) Inventors: Donald W. Milbrand, Jr., Duncannon, PA (US); Thomas S. Cohen, New Boston, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/744,328

(22) Filed: Dec. 23, 2003

(65) Prior Publication Data

US 2005/0136739 A1 Jun. 23, 2005

(51) Int. Cl.
*H01R 13/648* (2006.01)

(52) U.S. Cl. ..... 439/608; 439/108; 439/79

(58) Field of Classification Search ..... 439/608, 439/108, 101, 326, 79, 76.1
See application file for complete search history.

(56) References Cited

U.S. PATENT DOCUMENTS

| | | | | |
|---|---|---|---|---|
| 4,571,014 | A | 2/1986 | Robin et al. | 339/14 |
| 4,846,727 | A | 7/1989 | Glover et al. | 439/608 |
| 4,898,546 | A | 2/1990 | Elco et al. | 439/608 |
| 4,975,084 | A | 12/1990 | Fedder et al. | 439/608 |
| 5,055,069 | A | 10/1991 | Townsend et al. | 439/608 |
| 5,135,405 | A | 8/1992 | Fusselman et al. | 439/108 |
| 5,403,206 | A | 4/1995 | McNamara et al. | 439/608 |
| 6,042,386 | A | 3/2000 | Cohen et al. | 439/60 |
| 6,152,742 | A * | 11/2000 | Cohen et al. | 439/60 |
| 6,231,355 | B1 | 5/2001 | Trammel et al. | |
| 6,338,635 | B1 | 1/2002 | Lee | |
| 6,464,537 | B1 * | 10/2002 | Letourneau et al. | 439/608 |
| 6,468,106 | B1 * | 10/2002 | Durocher | 439/493 |
| 2002/0028592 | A1 | 3/2002 | Lee | |
| 2002/0173201 | A1 | 11/2002 | Lappoehn | |
| 2003/0003804 | A1 | 1/2003 | Letourneau et al. | |

FOREIGN PATENT DOCUMENTS

| | | | |
|---|---|---|---|
| DE | 100 51 819 | A1 | 4/2001 |
| EP | 3 337 634 | A1 | 10/1989 |
| WO | WO 98/02942 | A2 | 1/1998 |
| WO | WO 98/02942 | A3 | 9/1998 |

OTHER PUBLICATIONS

International Search Report, Mailing date Apr. 4, 2005.

* cited by examiner

*Primary Examiner*—Alexander Gilman
(74) *Attorney, Agent, or Firm*—Teradyne Legal Department

(57) ABSTRACT

There is disclosed a two-piece electrical connector assembly having a first electrical connector and a second electrical connector. The first electrical connector includes a plurality of first signal conductors disposed along first and second sides of a first insulative housing and first ground plates disposed along the first and second sides of the first insulative housing and positioned adjacent the plurality of first signal conductors. The first electrical connector defines a slot for receiving an edge of a first printed circuit board. The second electrical connector includes a plurality of second signal conductors disposed along first and second sides of a second insulative housing and second ground plates disposed along the first and second sides of the second insulative housing and positioned adjacent the plurality of second signal conductors. Each of the second ground plates has a surface with a first edge and a second edge, at least one of the first edge or the second edge being bent in the direction toward the corresponding second signal conductor. When the first electrical connector and the second electrical connector are mated, the first signal conductors and corresponding second signal conductors are substantially enclosed and shielded by the first and second ground plates.

8 Claims, 7 Drawing Sheets

HIGH SPEED CONNECTOR ASSEMBLY

BACKGROUND OF THE INVENTION

This invention relates generally to connectors for routing signals between printed circuit boards. More specifically, this invention relates to high density connectors that provide high speed signals in a low noise, impedance controlled manner.

Electrical connectors are widely used in modern electronic equipment. Sometimes, multiple printed circuit boards are connected together in a perpendicular fashion through a "backplane" or "motherboard". For example, many computers are assembled in this fashion. The connectors are typically made in one piece or two piece configurations, are connected to the printed circuit boards through tail portions, and are easy to mate/unmate. The connectors make the assembly and maintenance of the electronic equipment easier. The circuit cards plugged into the backplane or motherboard are called "daughter cards".

In other instances, circuit boards are connected together other than through a backplane. For example, circuit boards may be connected together in a parallel manner. When two circuit boards are connected in this fashion by a connector, such a connector is generally referred to as a "mezzanine" connector. Two circuit boards can also be connected edge-to-edge in a "docking" fashion. Connectors like those used on a backplane can be used in all of these case. The shape of tail portions of the connector contacts might be different to facilitate different mounting positions of the circuit boards. However, because similar connectors can be used, the term "backplane connector" can refer to either connectors in a backplane system or connectors used in other systems.

One-piece "card edge" connectors have plastic housings with rows of conductive contacts along either side of a slot down the middle. The daughter card has plated contact pads along one edge. That edge of the daughter card is plugged into the card edge connector. The conductive contacts are spring biased against the contact pads on the daughter card, completing conductive paths between the two circuit boards.

With two-piece connectors, an insulative housing is mounted on each circuit board to be connected. Each housing has numerous conductive contacts in it. When the two housings are mated, the conductive contacts in each housing touch, making electrical contact. Usually, some sort of spring force is used to keep the contacts together. Many connectors of this type have one set of contacts shaped as pins with the other set of contacts shaped as receptacles into which the pins can be inserted.

A refinement on the two-piece connector has been the use of ground plates in the insulative housing to enhance electrical characteristics. Examples of such connectors are found in U.S. Pat. Nos. 4,571,014, 4,846,727, 4,898,546, 4,975,084, 5,055,069, 5,135,405, 5,403,206 and 6,042,386. Each and every one of these references are incorporated herein.

While there are many types of connectors available, the inventors of the present invention have not observed a small, low profile two-piece connector capable of providing data transmission speeds from 2.5 GHz up to, in certain instances, 10 GHz in a low noise, impedance controlled manner.

SUMMARY OF THE INVENTION

In the preferred embodiment of a two-piece electrical connector assembly of the present invention, there is disclosed a first electrical connector and a second electrical connector.

The first electrical connector includes: (i) a first insulative housing having first and second sides and first and second ends, (ii) a plurality of first signal conductors disposed along the first and second sides of the first insulative housing, with each of the first signal conductors having a first contact end connectable to a first printed circuit board, a second contact end, and an intermediate portion therebetween, and (iii) first ground plates disposed along the first and second sides of the first insulative housing and positioned adjacent the plurality of first signal conductors, with the first ground plates having first contact ends connectable to the first printed circuit board. The first contact ends of the first signal conductors and the first contact ends of the first ground plates are aligned along the first and second sides of the first insulative housing such that a slot is created therebetween for receiving an edge of the first printed circuit board.

The second electrical connector includes: (i) a second insulative housing having first and second sides and first and second ends, (ii) a plurality of second signal conductors disposed along the first and second sides of the second insulative housing, with each of the second signal conductors having a first contact end connectable to a second printed circuit board, a second contact end, and an intermediate portion therebetween, and (iii) second ground plates disposed along the first and second sides of the second insulative housing and positioned adjacent the plurality of second signal conductors, with the second ground plates having first contact ends connectable to the second printed circuit board. Each of the second ground plates has a surface with a first edge and a second edge, at least one of the first edge or the second edge being bent such that when the plurality of second signal conductors and the corresponding second ground plates are disposed along the first and second sides of the second insulative housing, the bent edge is directed toward the corresponding second signal conductor.

When the first electrical connector and the second electrical connector are mated, the second contact ends of the first signal conductors make electrical contact with the second contact ends of the corresponding second signal conductors, and the first ground plates make electrical contact with the bent edges of the corresponding second ground plates such that the first signal conductors and corresponding second signal conductors are substantially enclosed and shielded by the first and second ground plates.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
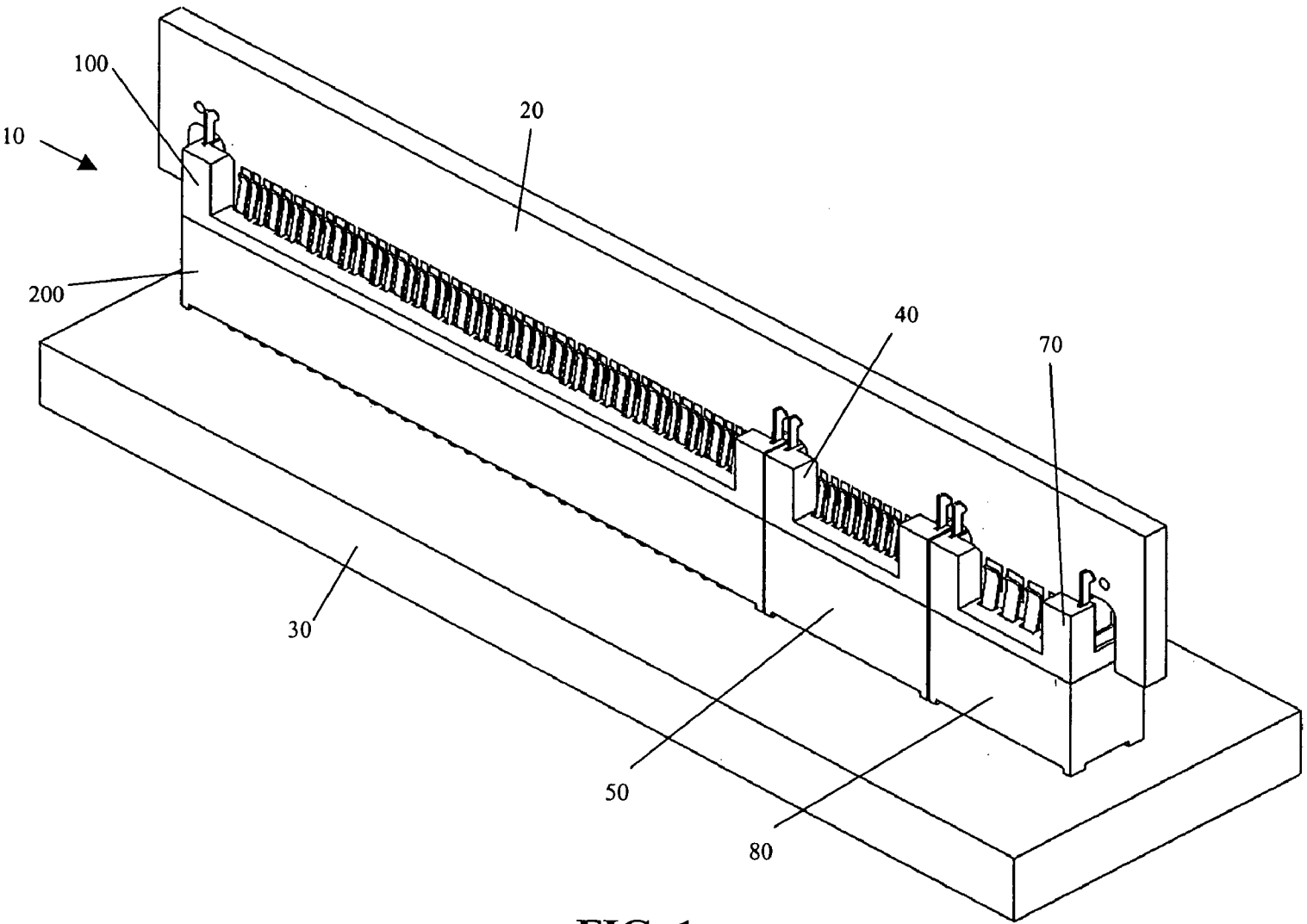
FIG. 1 is a perspective view of a mated electrical connector assembly of the present invention.
Figure 2:
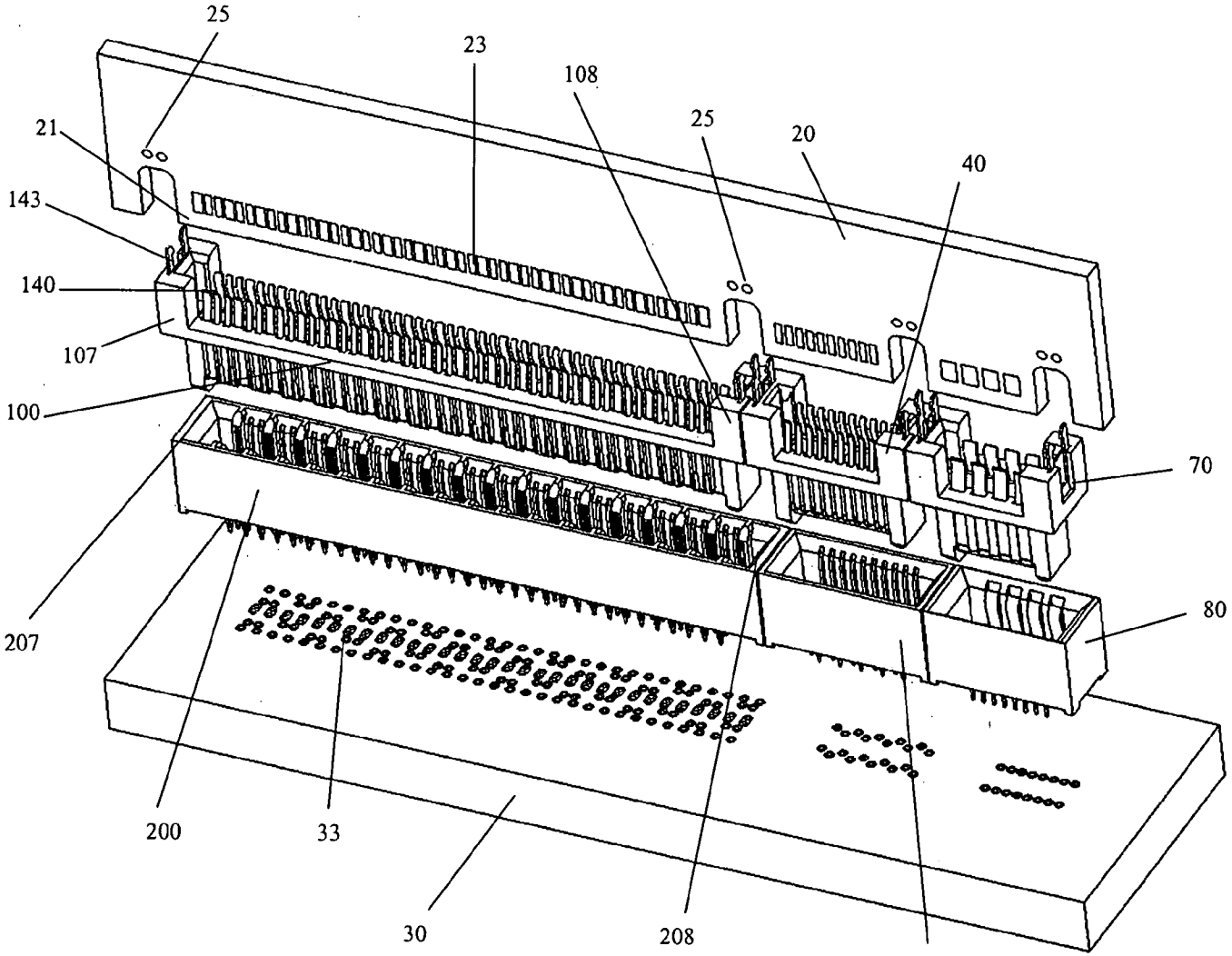
FIG. 2 is a semi-exploded view of the electrical connector assembly of FIG. 1, showing a first electrical connector connectable to a first printed circuit board and a second electrical connector connectable to a second printed circuit board.

Referring to FIGS. 1 and 2, there are shown a mated electrical connector assembly in accordance with an embodiment of the present invention. The electrical connector assembly 10 includes a first electrical connector 100 mateable to a second electrical connector 200. The first electrical connector 100 is connectable to a first printed circuit board 20 and the second electrical connector 200 is connectable to a second printed circuit board 30.

FIGS. 1 and 2 also show a third electrical connector 40 mateable to a fourth electrical connector 50, and a fifth electrical connector 70 mateable to a sixth electrical connector 80. In the drawings of this patent application, the first and second electrical connectors 100, 200 are shown as high speed differential pair signal electrical connectors, while the third and fourth electrical connectors 40, 50 are shown as low speed or single-ended signal electrical connectors, and the fifth and sixth electrical connectors 70, 80 are shown as power connectors. The third, fourth, fifth and sixth electrical connectors 40, 50, 70, 80 are not intended to be part of this invention, and are shown only to demonstrate that the electrical connector assembly of the present invention can be utilized in conjunction with other electrical connectors. Further, while the first and second electrical connectors 100, 200 are shown as differential pair signal electrical connectors, it should be apparent to one of ordinary skill in the art reading this Detailed Description Of The Invention that the inventive concepts described herein may be applied to other types of electrical connectors, including single-ended signal electrical connectors.

Figure 3:
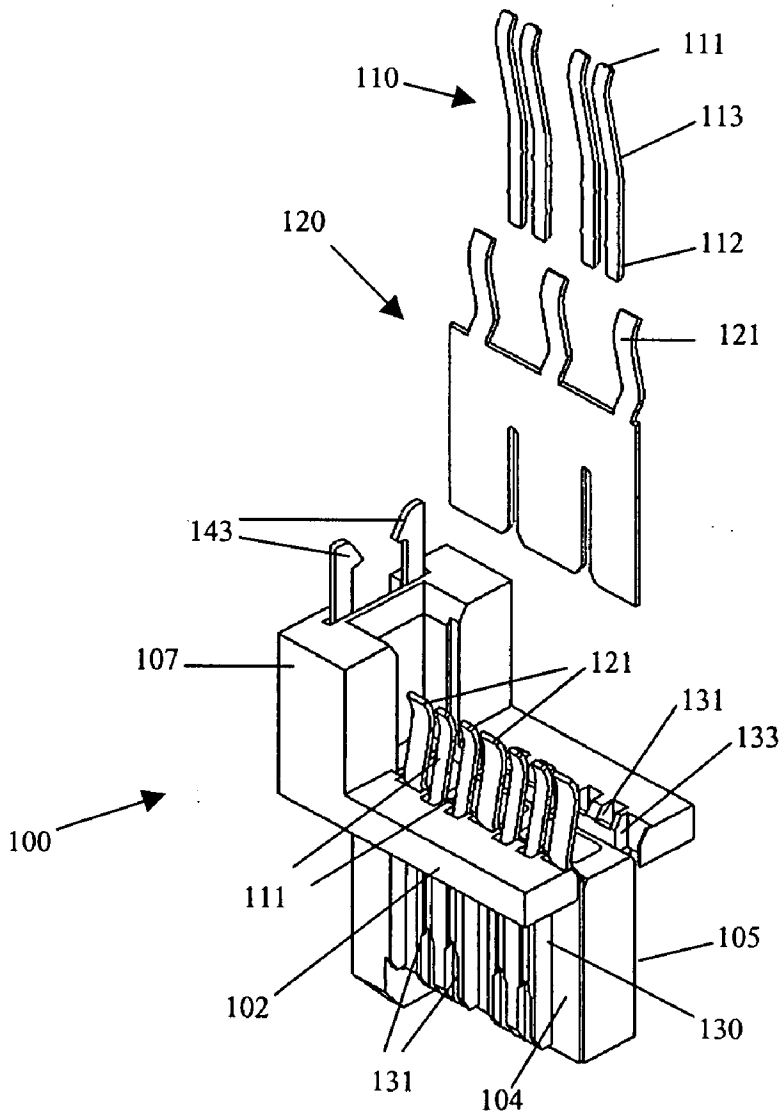
FIG. 3 is a semi-exploded partial view of the first electrical connector of FIG. 2, showing signal conductors and a portion of a ground plate outside an insulative housing.

FIG. 3 shows a semi-exploded partial view of the first electrical connector 100 of FIGS. 1 and 2. The first electrical connector 100 includes an insulative housing 102 having first and second sides 104, 105 and first and second ends 107, 108 (see also FIG. 2). A plurality of signal conductors 110 are disposed along the first and second sides 104, 105 of the insulative housing 102. Each signal conductor 110 has a first contact end 111 connectable to the first printed circuit board 20, a second contact end 112 that is mateable to the corresponding contact end of the second electrical connector 200, and an intermediate portion 113 therebetween. The first electrical connector 100 also includes ground plates 120 disposed along the first and second sides 104, 105 of the insulative housing 102. In the preferred embodiment, there is one ground plate 120 for each insulative housing side 104, 105. However, it is also possible to have two or more ground plates disposed along each insulative housing side 104, 105.

The insulative housing 102 preferably has raised portions 130, with each raised portion 130 providing passages 131 for receiving the differential pair signal conductors 110. Note that for a single-ended signal version of the electrical connector of the present invention, there would be one passage for receiving the single signal conductor. The insulative housing 102 also has openings 133 for receiving the ground plates 120. The openings 133 are positioned relative to the passages 131 such that when disposed in the insulative housing 102, the signal conductors 110 are adjacent the ground plates 120. Each ground plate 120 has first contact ends 121 connectable to the first printed circuit board 20. In the differential pair signal electrical connector of the preferred embodiment, the first contact ends 111 for each pair of differential signal conductors 110 are "sandwiched" by a first contact end 121 of the ground plate 120 on either side thereof.

Note that for each side 104, 105 of the insulative housing 102, the first contact ends 111 of the signal conductors 110 and the first contact ends 121 of the ground plate 120 are aligned along a line. Further, the first contact ends 111, 121 of the first and second sides 104, 105 form a slot 140 therebetween for receiving an edge 21 of the first printed circuit board 20. As shown in FIG. 2, the edge 21 of the first printed circuit board 20 is provided with contact pads 23. And it is to these contact pads 23 of the first printed circuit board 20 that the first contact ends 111, 121 are electrically connected. Note that although it is not visible in FIG. 2, the other side of the first printed circuit board 20 also has contact pads 23 corresponding to the first contact ends 111, 121 of the first electrical connector 100.

The first contact ends 111 of the signal conductors 110 and the first contact ends 121 of the ground plates 120 are configured to provide a spring bias. The first contact ends 111, 121 are electrically connected to the contact pads 23 of the first printed circuit board 20 by means of soldering in the preferred embodiment. The spring bias, in the preferred embodiment, is provided by the curved shape of the first contact ends 111, 121. The spring bias of the first contact ends 111, 121 provides the desired flexibility when receiving the edge 21 of the first printed circuit board 20, as well as during soldering to the corresponding contact pads 23. The insulative housing 102 is provided with holding members 143 for securely holding the first printed circuit board 20. The holding members 143, in the preferred embodiment, are shaped with hook-like projections that engage corresponding apertures 25 in the first printed circuit board 20.

The width of the first contact ends 121 of the ground plates 120 is preferably greater than the width of the first contact ends 111 of the signal conductors 110. Further, the space between the first contact end 121 of the ground plate 120 and the adjacent first contact end 111 of the signal conductor 110 vs. the space between the first contact ends 111 of adjacent signal conductors 110 is predetermined. In this manner, there is provided a coplanar waveguide effect from the shielding perspective.

Figure 4:
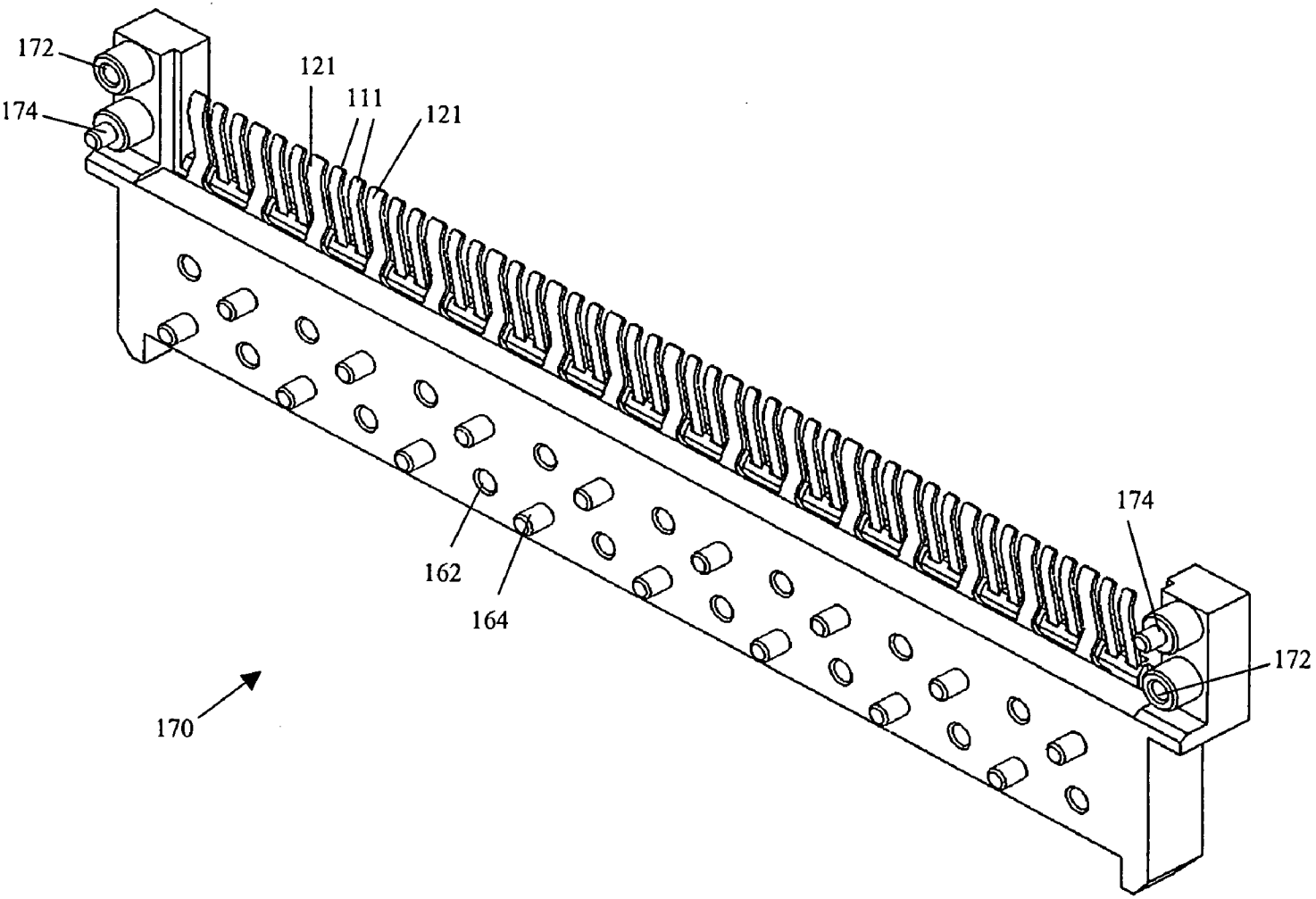
FIG. 4 is a perspective view of an alternative embodiment of the first electrical connector of FIG. 2, showing an insulative housing half with signal conductors and a ground plate.
Figure 5:
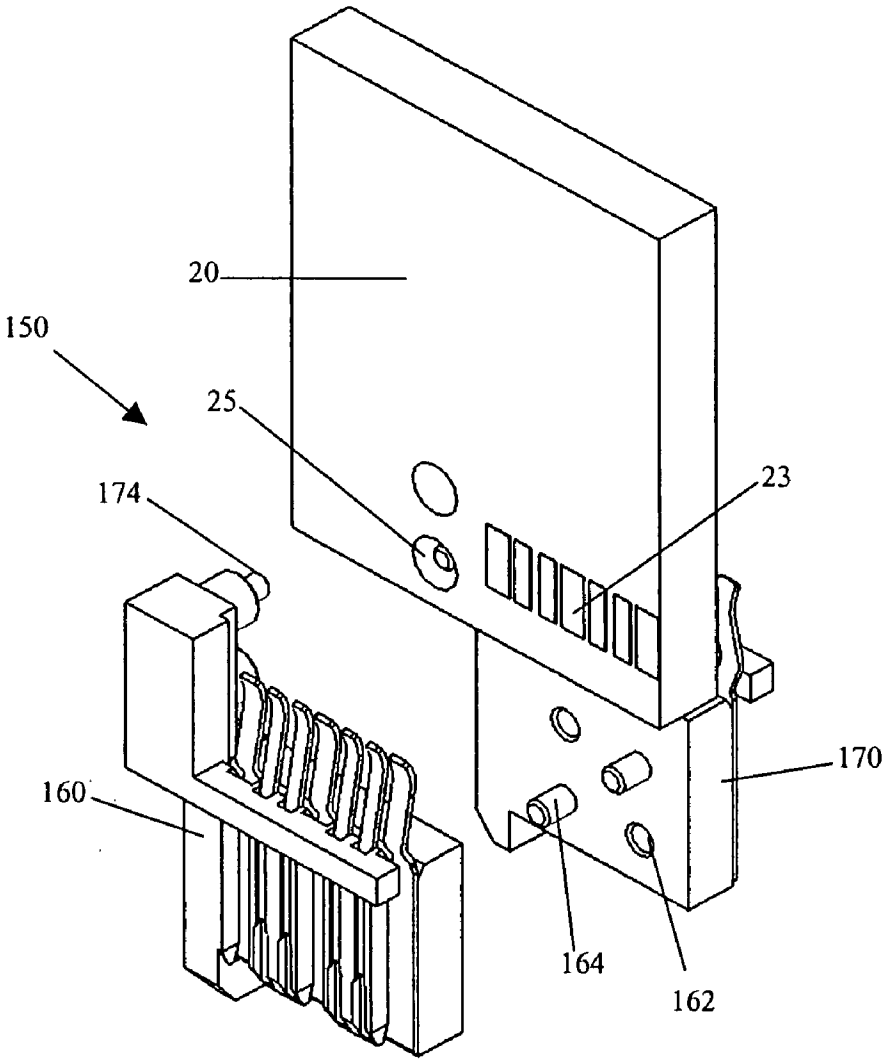
FIG. 5 is a perspective partial view of the first electrical connector of FIG. 4, showing a portion of the insulative housing half of FIG. 4 about to mate with the corresponding other insulative housing half of the first electrical connector.

Referring now to FIGS. 4 and 5, there is shown an alternative embodiment of the first electrical connector of FIG. 2. The alternative first electrical connector 150 includes a first insulative housing half 160 and a second insulative housing half 170. FIG. 4 shows the second insulative housing half 170 in detail. In the preferred embodiment, the first and the second insulative housing halves 160, 170 are identical to one another. By having the same first and second insulative housing halves 160, 170 (as opposed to different first and second housing halves), there are significant manufacturing and cost benefits.

Each insulative housing half 160, 170 includes a plurality of signal conductors 110 and a ground plate 120 disposed therein. The signal conductors 110 and the ground plate 120 are preferably the same as those used in the first electrical connector 100 of FIG. 3. In effect, it is as if the first electrical connector 100 of FIG. 3 has been cut lengthwise across the middle.

Each insulative housing half 160, 170 is provided with corresponding attachment members 162, 164 that engage one another when the insulative housing halves 160, 170 are brought together to form the assembled insulative housing 150. As shown in FIGS. 4 and 5, attachment members 164 are pegs and attachment members 162 are receptacles for receiving the pegs. However, it should be apparent to one of ordinary skill in the art that other attachment means for engaging the first and second insulative housing halves 160, 170 may also be utilized, such as rivets. Further, each insulative housing half 160, 170 is provided with holding members 172, 174 that engage one another—through the apertures 25 in the first printed circuit board 20—when the insulative housing halves 160, 170 are brought together to form the assembled insulative housing 150. As shown in FIGS. 4 and 5, holding members 174 are male and corresponding holding members 172 are female for receiving the male holding members 174.

There is at least one identifiable advantage proffered by the alternative first electrical connector 150 of FIGS. 4 and 5. That is, because the first printed circuit board 20 does not need to be slid into the slot 140 as is the case with the first electrical connector 100 shown in FIG. 2, there are not the issues of solder paste being pushed away from the mating interface of the first contact ends 111, 121 and the contact pads 23. One potential disadvantage of the alternative first electrical connector 150 may be the need to ensure that the first and the second housing halves 160, 170 are securely engaged to one another and to the first printed circuit board 20.

Figure 6:
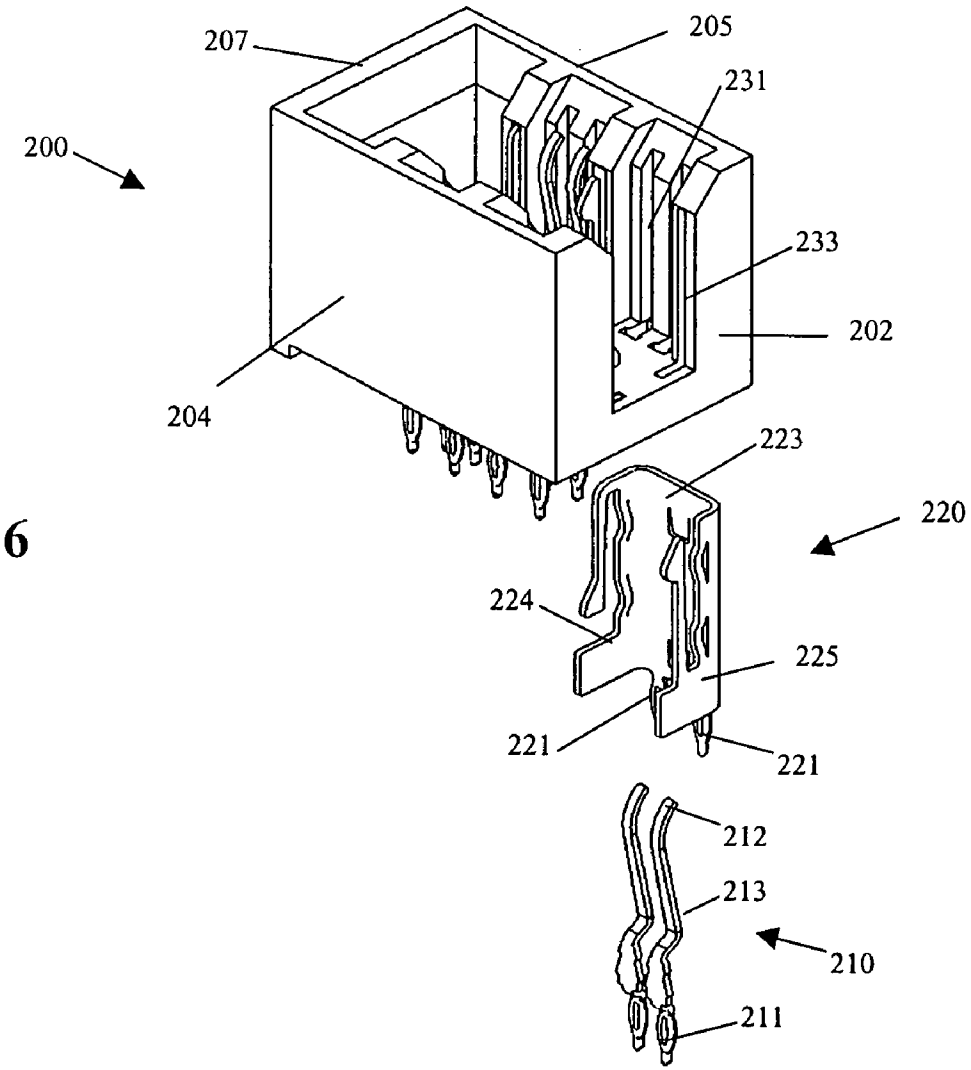
FIG. 6 is a semi-exploded partial view of the second electrical connector of FIG. 2, showing signal conductors and a ground plate outside an insulative housing.

Referring now to FIG. 6, there is shown a semi-exploded partial view of the second electrical connector 200 of FIGS. 1 and 2. The second electrical connector 200 includes an insulative housing 202 having first and second sides 204, 205 and first and second ends 207, 208 (see also FIG. 2). A plurality of signal conductors 210 are disposed along the first and second sides 204, 205 of the insulative housing 202. Each signal conductor 210 has a first contact end 211 connectable to the second printed circuit board 30, a second contact end 212 that is mateable to the second contact end 112 of the corresponding signal conductor 110 of the first electrical connector 100, and an intermediate portion 213 therebetween. The second electrical connector 200 also includes ground plates 220 disposed along the first and second sides 204, 205 of the insulative housing 202 and positioned adjacent the signal conductors 210. In the preferred embodiment, there is one ground plate 220 for each pair of differential signals. For a single-ended signal, there would preferably be one ground plate for one signal.

The insulative housing 202 provides passages 231 for receiving the differential pair signal conductors 210. Note that for a single-ended version of the electrical connector of the present invention, there would be one passage for receiving the single signal conductor. The insulative housing 202 also has openings 233 for receiving the ground plates 220.

Each ground plate 220 has first contact ends 221 connectable to the second printed circuit board 30. For the differential pair signal conductors shown in the drawings, each ground plate 220 preferably has two first contact ends 221. Also, each ground plate 220 has a surface 223 with a first edge 224 and a second edge 225. At least one of the first edge 224 or the second edge 225, and preferably both the first and second edges 224, 225, is bent in the direction toward the corresponding signal conductors 210. Note that when the signal conductors 210 and the corresponding ground plates 220 are disposed along the first and second sides 204, 205 of the insulative housing 202, each differential pair of signal conductors 210 is shielded on substantially three sides by the ground plates 220.

The first contact ends 211 of the signal conductors 210 and the first contact ends 221 of the ground plates 220 are illustrated as eye-of-the-needle contact ends. These contact ends 211, 221 are inserted into corresponding conductive holes 33 in the second printed circuit board 30 (see FIG. 2). It should be apparent to one of ordinary skill in the art, however, that other types of contact end configurations may be utilized for electrically connecting to a printed circuit board. The second contact ends 212 of the signal conductors 210 are configured to provide a spring bias for electrically connecting to the second contact ends 112 of the corresponding signal conductors 110 of the first electrical connector 100. And each bent edge 224, 225 of the ground plate 220 is preferably configured as an arm to provide spring bias for electrically connecting to the ground plate 120 of the first electrical connector 110.

Figure 7:
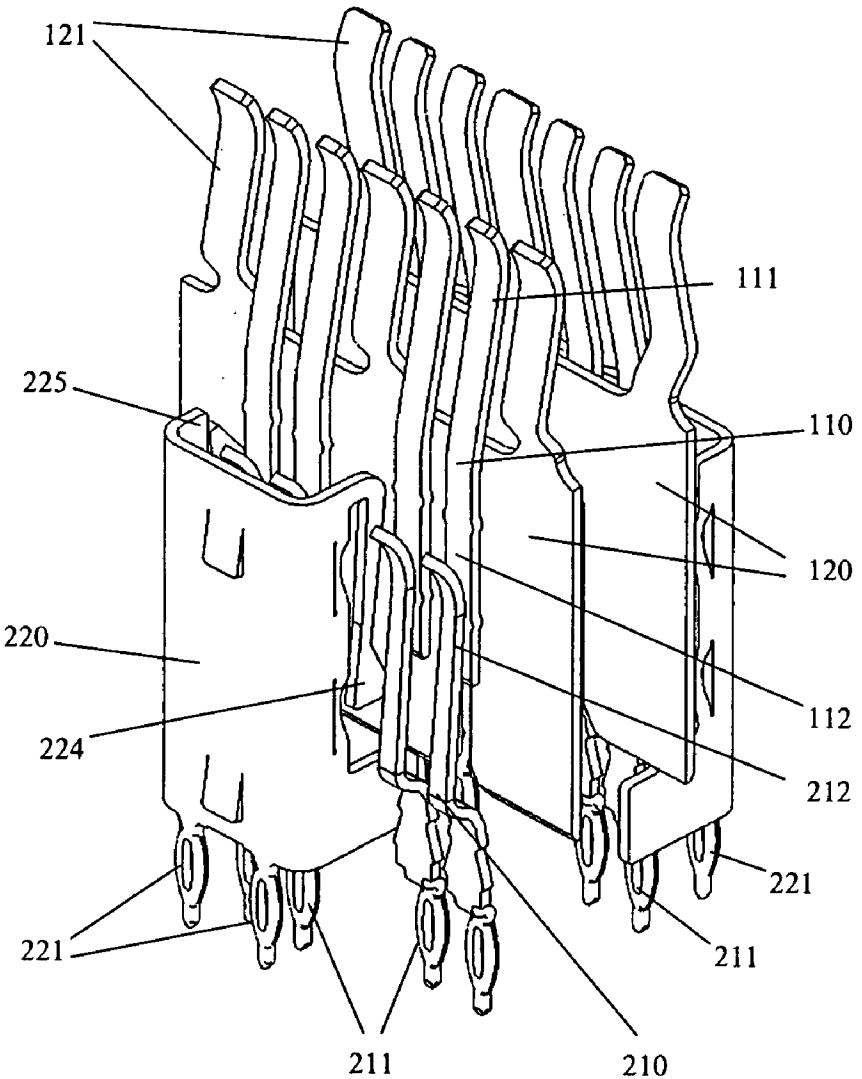
FIG. 7 is a perspective partial view of just the mated signal conductors and ground plates of the electrical connector assembly of FIG. 1.

Referring now to FIG. 7, there is illustrated a perspective partial view of just the mated signal conductors and ground plates (so excluding insulative housings) of the electrical connector assembly 10 of FIGS. 1 and 2. When the first electrical connector 100 and the second electrical connector 200 are mated, the second contact ends 112 of the signal conductors 110 make electrical contact with the second contact ends 212 of the corresponding signal conductors 210. Also, the ground plates 120 make electrical contact with the bent edges 224, 225 of the corresponding ground plates 220. Note that the mating signal conductors 110, 210 of the first and second electrical connectors 100, 200, respectively, are substantially enclosed and electrically shielded by the mating ground plates 120, 220.

Having described the preferred and alternative embodiments of the invention, it will now become apparent to one of ordinary skill in the art that other embodiments incorporating their concepts may be used. For example, while the drawings show a differential pair signal electrical connector assembly, a single-ended signal electrical connector assembly may be utilized. Also, while the drawings show the second electrical connector having ground plates with at least one edge bent in the direction of the corresponding signal conductor, it could be the first electrical connector instead that has the ground plates with projections that project in the direction of the corresponding signal conductors such that when the first and second electrical connectors are mated, the mating signal conductors of the first and second electrical connectors are substantially enclosed and shielded by the mating ground plates.

It is felt therefore that these embodiments should not be limited to disclosed embodiments but rather should be limited only by the spirit and scope of the appended claims.

All publications and references cited herein are expressly incorporated herein by reference in their entirety.

What is claimed is:

1. An electrical connector assembly comprising:

a first electrical connector that includes:

a first insulative housing having first and second sides and first and second ends;

a plurality of first signal conductors disposed along the first and second sides of the first insulative housing, each of the first signal conductors having a first contact end connectable to a first printed circuit board, a second contact end, and an intermediate portion therebetween;

first ground plates disposed along the first and second sides of the first insulative housing and positioned adjacent the plurality of first signal conductors, the first ground plates having first contact ends connectable to the first printed circuit board;

the first contact ends of the first signal conductors and the first contact ends of the first ground plates are aligned along the first and second sides of the first insulative housing such that a slot is created therebetween for receiving an edge of the first printed circuit board;

a second electrical connector that includes:

a second insulative housing having first and second sides and first and second ends;

a plurality of second signal conductors disposed along the first and second sides of the second insulative housing, each of the second signal conductors having a first contact end connectable to a second printed circuit board, a second contact end, and an intermediate portion therebetween;

second ground plates disposed along the first and second sides of the second insulative housing and positioned adjacent the plurality of second signal conductors, the second ground plates having first contact ends connectable to the second printed circuit board;

each of the second ground plates having a surface with a first edge and a second edge, at least one of the first edge or the second edge being bent such that when the plurality of second signal conductors and the corresponding second ground plates are disposed along the first and second sides of the second insulative housing, the bent edge is directed toward the corresponding second signal conductor; and when the first electrical connector and the second electrical connector are mated, the second contact ends of the first signal conductors make electrical contact with the second contact ends of the corresponding second signal conductors, and the first ground plates make electrical contact with the bent edges of the corresponding second ground plates such that the each of first signal conductors and corresponding second signal conductors are at least partially enclosed and shielded by the first and second ground plates.

2. The electrical connector assembly of claim 1, wherein the first insulative housing of the first electrical connector further comprises a first housing half and a second housing half, the first and second housing halves including corresponding attachment members that engage one another to form the first insulative housing.

3. The electrical connector assembly of claim 1, wherein the first contact ends of the first signal conductors and the first ground plates are configured to provide a spring bias.

4. The electrical connector assembly of claim 1, wherein the second contact ends of the second signal conductors are configured to provide a spring bias for electrically connecting to the corresponding second contact ends of the first signal conductors.

5. The electrical connector assembly of claim 1, wherein both the first edge and the second edge of each second ground plate is bent in the direction toward the corresponding second signal conductor.

6. The electrical connector assembly of claim 1, wherein the bent edge of each of the second ground plates comprises an arm configured to provide spring bias.

7. The electrical connector assembly of claim 1, wherein the first insulative housing further comprises holding members for securely holding the first printed circuit board.

8. The electrical connector assembly of claim 1, wherein the first contact ends of the first ground plates have a first width and the first contact ends of the first signal conductors have a second width, the first width being greater than the second width.

* * * * *